US010152018B2

(12) United States Patent
Hayakawa et al.

(10) Patent No.: US 10,152,018 B2
(45) Date of Patent: Dec. 11, 2018

(54) IMAGE FORMING APPARATUS HAVING DEVELOPING CARTRIDGE MOVABLE RELATIVE TO PHOTOSENSITIVE DRUM

(71) Applicant: BROTHER KOGYO KABUSHIKI KAISHA, Nagoya-shi, Aichi-ken (JP)

(72) Inventors: Atsushi Hayakawa, Okazaki (JP); Yoshiteru Hattori, Ichinomiya (JP); Takuya Yamaguchi, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/376,918

(22) Filed: Dec. 13, 2016

(65) Prior Publication Data

US 2017/0248910 A1 Aug. 31, 2017

(30) Foreign Application Priority Data

Feb. 29, 2016 (JP) ..... 2016-037665

(51) Int. Cl.
*G03G 21/16* (2006.01)
*G03G 21/18* (2006.01)
*G03G 15/08* (2006.01)

(52) U.S. Cl.
CPC ..... *G03G 21/1652* (2013.01); *G03G 15/0863* (2013.01); *G03G 21/1647* (2013.01); *G03G 21/1821* (2013.01); *G03G 21/1871* (2013.01)

(58) Field of Classification Search
CPC ..... G03G 21/1871; G03G 15/0863; G03G 21/1647; G03G 21/1652; G03G 21/1821
See application file for complete search history.

(56) References Cited

U.S. PATENT DOCUMENTS

2008/0317499 A1 12/2008 Nishimura
2009/0190958 A1* 7/2009 Wang ..... G03G 21/1647 399/228
2013/0051849 A1 2/2013 Itabashi et al.
2017/0269544 A1* 9/2017 Itabashi ..... G03G 21/1676
2017/0277119 A1* 9/2017 Sakai ..... G03G 21/1867

FOREIGN PATENT DOCUMENTS

JP 2003-255641 A 9/2003
JP 2009-3174 A 1/2009
JP 2013-54058 A 3/2013

* cited by examiner

*Primary Examiner* — Carla J Therrien
(74) *Attorney, Agent, or Firm* — Merchant & Gould P.C.

(57) ABSTRACT

An image forming apparatus includes a developing cartridge, a photosensitive drum, a lever, and an electrical connector. The developing cartridge includes a developing roller rotatable about a first axis extending in a first direction, a memory storing information related to the developing cartridge, and an electrical contact electrically connected to the memory. The photosensitive drum is rotatable about a second axis extending in the first direction. The lever moves the developing cartridge between a first position where a surface of the developing roller contacts a surface of the photosensitive drum and a second position where the surface of the developing roller separates from the surface of the photosensitive drum. The electrical connector contacts the electrical contact in the second position of the developing cartridge, and separates from the electrical contact in the first position of the developing cartridge.

9 Claims, 12 Drawing Sheets

IMAGE FORMING APPARATUS HAVING DEVELOPING CARTRIDGE MOVABLE RELATIVE TO PHOTOSENSITIVE DRUM

CROSS REFERENCE TO RELATED APPLICATION

This application claims priority from Japanese Patent Application No. 2016-037665 filed Feb. 29, 2016. The entire content of the priority application is incorporated herein by reference.

TECHNICAL FIELD

The present disclosure relates to an image forming apparatus.

BACKGROUND

An image forming apparatus including a drum cartridge and a developing cartridge attachable to and detachable from the drum cartridge is known in the art. The drum cartridge includes a photosensitive drum, and the developing cartridge includes a developing roller.

Conventionally, the developing cartridge is movable between a first position and a second position by a lever provided at the drum cartridge in the image forming apparatus. The developing roller and the photosensitive drum are in contact with each other at the first position, and these are separated from each other at the second position.

SUMMARY

In the conventional image forming apparatus, the developing cartridge includes, for example, an IC chip storing information related to the developing cartridge. The image forming apparatus may provide an electrical connector contactable with the IC chip.

In the image forming apparatus described above, contacting pressure between the IC chip and the electrical connector may affect a contacting state between the developing roller and the photosensitive drum in a state where the IC chip is brought into contact with the electrical connector while the developing roller is in contact with the photosensitive drum. Because the contacting state between the developing roller and the photosensitive drum is a factor affecting imaging quality, preferably, there may be a case where the contacting pressure between the IC chip and the electrical connector does not affect the contacting state between the developing roller and the photosensitive drum.

It is therefore an object of the disclosure to provide an image forming apparatus capable of providing a stable contact between the developing roller and the photosensitive drum regardless of the contact between a memory of the developing cartridge and the electrical connector provided at a housing of the image forming apparatus.

According to one aspect, the disclosure provides an image forming apparatus including: a developing cartridge, a photosensitive drum, a lever, and an electrical connector. The developing cartridge includes: a developing roller, a memory, and an electrical contact. The developing roller is rotatable about a first axis extending in a first direction. The memory is configured to store information related to the developing cartridge. The electrical contact is electrically connected to the memory. The photosensitive drum is rotatable about a second axis extending in the first direction. The lever is configured to move the developing cartridge between a first position at which a surface of the developing roller and a surface of the photosensitive drum are in contact with each other and a second position at which the surface of the developing roller and the surface of the photosensitive drum are out of contact with each other. The electrical connector is configured to be in contact with the electrical contact in a state where the developing cartridge is positioned at the second position. The electrical connector is configured to be out of contact with the electrical contact in a state where the developing cartridge is positioned at the first position.

According to another aspect, the disclosure provides an image forming apparatus including: a housing, a developing cartridge, a drum cartridge, a lever, and an electrical connector. The developing cartridge includes: a developing roller, a memory, and a first electrical contact. The developing roller is rotatable about a first axis extending in a first direction. The memory is configured to store information related to the developing cartridge. The first electrical contact is electrically connected to the memory. The developing cartridge is attachable to the drum cartridge. The drum cartridge is configured to attach to the housing, and includes: a photosensitive drum, a second electrical contact, and a third electrical contact. The photosensitive drum is rotatable about a second axis extending in the first direction. The second electrical contact is configured to contact with the first electrical contact. The third electrical contact is electrically connected to the second electrical contact. The third electrical contact is disposed at a position different from a position at which the second electrical contact is disposed. The lever is configured to move the developing cartridge between a first position at which a surface of the developing roller and a surface of the photosensitive drum are in contact with each other and a second position at which the surface of the developing roller and the surface of the photosensitive drum are out of contact with each other. The second electrical contact is in contact with the first electrical contact in a state where the developing cartridge is at the second position. The second electrical contact is out of contact with the first electrical contact in a state where the developing cartridge is at the first position. The electrical connector is configured to contact with the third electrical contact.

BRIEF DESCRIPTION OF THE DRAWINGS

The particular features and advantages of the disclosure will become apparent from the following description taken in connection with the accompanying drawings, in which.

DETAILED DESCRIPTION

First Embodiment

An image forming apparatus according to a first embodiment will be described with reference to FIGS. 1 through 6.

1. Overview of Image Forming Apparatus 1

Figure 1:
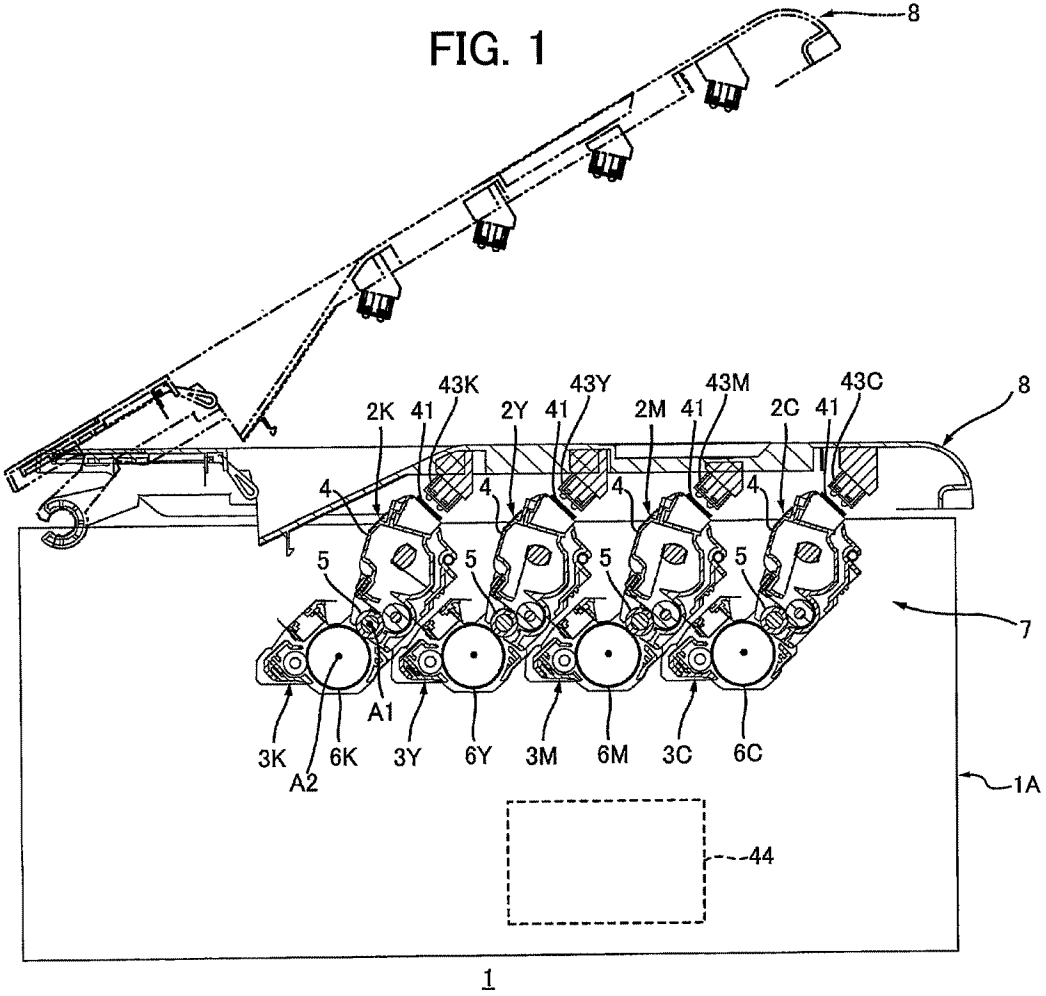
FIG. 1 is a schematic view of an image forming apparatus according to a first embodiment.

As illustrated in FIG. 1, an image forming apparatus 1 includes a housing 1A, a plurality of developing cartridges 2K, 2Y, 2M, 2C and a plurality of drum cartridges 3K, 3Y, 3M, 3C. The developing cartridge 2K accommodates therein black toner as developing agent. The developing cartridge 2Y accommodates therein yellow toner. The developing cartridge 2M accommodates therein magenta toner. The developing cartridge 2C accommodates therein cyan toner. The developing cartridges 2K, 2Y, 2M, 2C are arrayed in a predetermined direction (arraying direction) with a space between neighboring cartridges.

The drum cartridges 3K, 3Y, 3M, 3C are arrayed in the predetermined direction. The developing cartridge 2K is attachable to the drum cartridge 3K. Further, the drum cartridge 3K is attachable to the housing 1A while the developing cartridge 2K is attached to the drum cartridge 3K. Similarly, the developing cartridge 2Y is attachable to the drum cartridge 3Y. Further, the drum cartridge 3Y is attachable to the housing 1A while the developing cartridge 2Y is attached to the drum cartridge 3Y. The developing cartridge 2M is attachable to the drum cartridge 3M. Further, the drum cartridge 3M is attachable to the housing 1A while the developing cartridge 2M is attached to the drum cartridge 3M. The developing cartridge 2C is attachable to the drum cartridge 3C. Further, the drum cartridge 3C is attachable to the housing 1A while the developing cartridge 2C is attached to the drum cartridge 3C.

The housing 1A has an internal space in which an accommodating portion 7 is provided. The plurality of developing cartridges and the drum cartridges are accommodatable in the accommodating portion 7. That is, the accommodating portion 7 is adapted to accommodate therein the plurality of drum cartridges installing corresponding developing cartridges.

A cover 8 is for covering the accommodating portion 7. As illustrated in FIG. 1, the cover 8 is movable between an open position as indicated by a two dotted chain line and a closed position as indicated by a solid line. In the open position, the cover 8 opens the accommodating portion 7 so that the plurality of developing cartridges and the plurality of drum cartridges can be detached from the accommodating portion 7. In the closed position, the cover 8 closes the accommodating portion 7, so that the plurality of developing cartridges and the plurality of drum cartridges are covered by the cover 8.

As illustrated in FIG. 1, the cover 8 includes a plurality of electrical connectors 43K, 43Y, 43M, 43C. These connectors 43K, 43Y, 43M, 43C are arrayed in the predetermined direction with a space between neighboring connectors. These connectors 43K, 43Y, 43M, 43C are adapted to face IC chips 41 of the developing cartridges 2K, 2Y, 2M, 2C, respectively, when the cover 8 is at the closed position. Incidentally, respective contact between the IC chips 41 and the electric connectors 43K, 43Y, 43M, 43C will be described later.

As illustrated in FIG. 1, the image forming apparatus 1 includes a controller 44. The controller 44 is electrically connected to the electrical connectors 43K, 43Y, 43M, 43C. Further, the controller 44 is adapted to control a motor (not shown).

In the present embodiment, a surface of a photosensitive drum 6K of the drum cartridge 3K is in contact with a surface of a developing roller 5 of the developing cartridge 2K in a state where the developing cartridge 2K is attached to the drum cartridge 3K. Further, the surface of the developing roller 5 is separated from the surface of the photosensitive drum 6K when the developing cartridge 2K is moved relative to the drum cartridge 3K. Details of the developing cartridge and the drum cartridge will next be described.

2. Developing Cartridge

The developing cartridges 2K, 2Y, 2M, 2C have structures identical to each other. Thus, in the following description, the structure of the developing cartridge 2K will be described to avoid duplicating description with respect to the structures of the developing cartridges 2Y, 2M, 2C.

As illustrated in FIG. 1, the developing cartridge 2K includes a casing 4, and the developing roller 5. The casing 4 is adapted to accommodate therein developing agent such as toner. The developing roller 5 is rotatable about a first axis A1 extending in a first direction perpendicular to the predetermined direction. The developing roller 5 has cylindrical shape, and a part of the peripheral surface is exposed to an outside of the casing 4.

Figure 2:
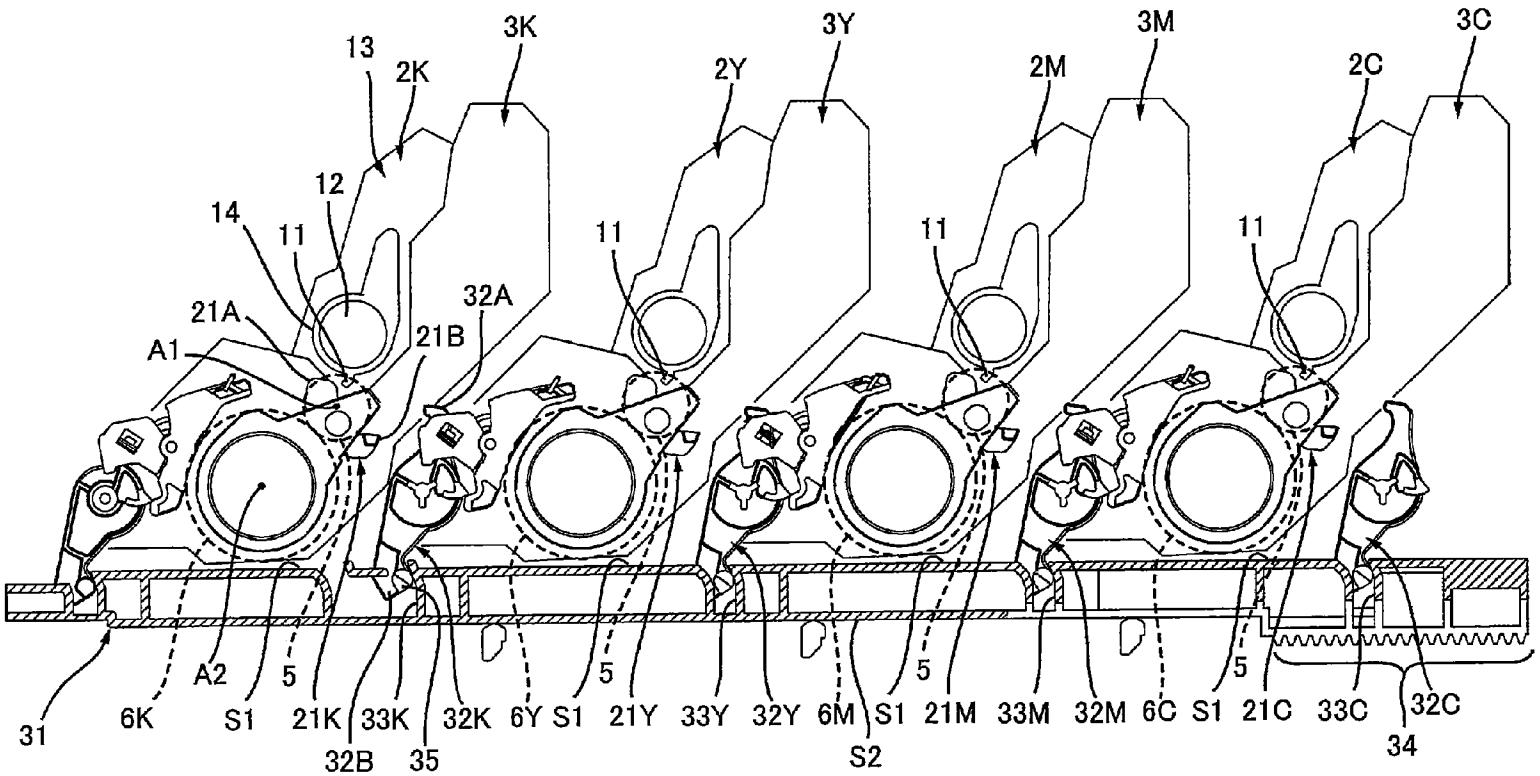
FIG. 2 is a view for description of movement of developing cartridges in the image forming apparatus according to the first embodiment.
Figure 3:
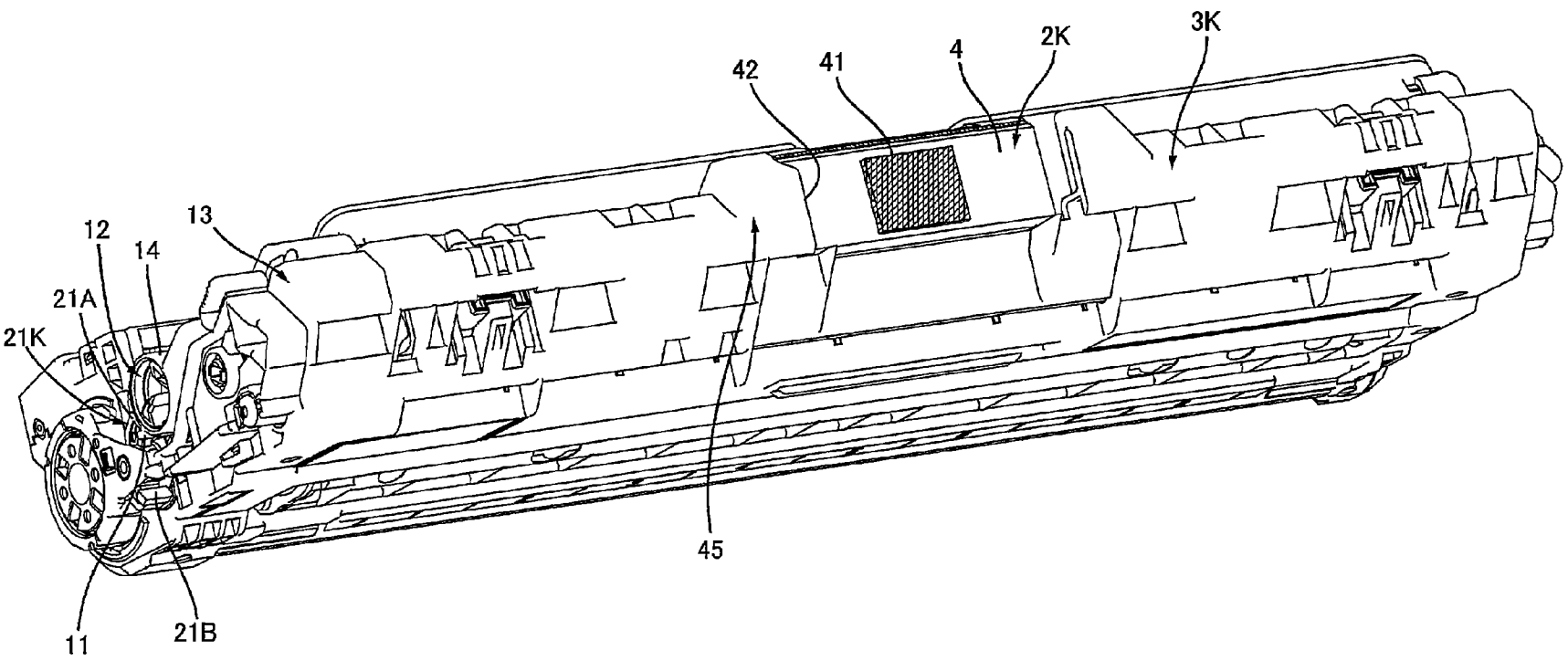
FIG. 3 is a perspective view of the developing cartridge and a drum cartridge according to the first embodiment.

As illustrated in FIGS. 2 and 3, the developing cartridge 2K further includes a protrusion 11, a coupling 12, a gear cover 13, and a collar 14. The coupling 12 is positioned at a side surface of the casing 4 in the first direction, and has cylindrical shape extending in the first direction. The coupling 12 is adapted to receive a driving force from a housing 1A side, when the developing cartridge 2K is mounted to the housing 1A. The coupling 12 is rotatable about an axis extending in the first direction by the driving force. The driving force received at the coupling 12 is transmitted to the developing roller 5 through a gear train (not shown). Thus, the developing roller 5 rotates. The gear cover 13 is attached to the side surface of the casing 4 in the first direction, and is adapted to cover the gear train (not shown).

The collar 14 is positioned at a side surface of the gear cover 13 in the first direction, and has hollow cylindrical shape extending in the first direction. The collar 14 is positioned along an outer peripheral surface of the coupling 12 to cover the same. However, the collar 14 does not cover a free end portion of the coupling 12 in the first direction, so that the free end portion is exposed to the outside.

The protrusion 11 is positioned at a side surface of the gear cover 13 in the first direction. More specifically, the protrusion 11 protrudes radially outwardly from the collar 14 in a radial direction of the coupling 12, and the protrusion 11 extends in the first direction. Further, the protrusion 11 is positioned closer to the first axis A1 than to a second axis A2 (described later) of the photosensitive drum 6K, and is positioned closer to the developing roller 5 than the coupling 12 to the developing roller 5. The developing cartridge 2K further includes another protrusion (not shown) positioned opposite to the protrusion 11 with respect to the casing 4 in the first direction. The other protrusion and the protrusion 11 are aligned with each other in the first direction.

Further, as illustrated in FIG. 1, the developing cartridge 2K includes the IC chip 41. The IC chip 41 includes an integrated circuit having a memory, and an electrical contact electrically connected to the integrated circuit. The memory stores therein information related to the developing cartridge 2K, such as a color of the developing agent accommodated in the developing cartridge 2K. More specifically, the information is a black developing agent accommodated in the developing cartridge 2K. The information is related to newness of the developing cartridge 2K such as an old developing cartridge or a new developing cartridge. That is, the memory stores information of new cartridge when the developing cartridge 2K is new. Further, the information is related to numbers of sheets available for printing with the developing cartridge 2K. More specifically, the memory stores information of 6,000 sheets as the numbers of sheets on which image can be formed with the cartridge 2K.

As illustrated in FIGS. 1 and 3, the developing roller 5 is positioned at one end portion of the casing 4, and the IC chip 41 is positioned at another end portion thereof in a second direction. The second direction may be perpendicular to the predetermined direction and the first direction. More specifically, the IC chip 41 is positioned at and adhered to an outer surface of the other end portion of the casing 4 in the second direction. The IC chip 41 is positioned at an intermediate portion of the developing cartridge 2K in the first direction.

3. Drum Cartridge

The drum cartridges 3K, 3Y, 3M, 3C have structures identical to each other. Thus, in the following description, the structure of the drum cartridge 3K will be described to avoid duplicating description with respect to the structures of the drum cartridges 3Y, 3M, 3C.

The drum cartridge 3K includes the photosensitive drum 6K rotatable about the second axis A2 extending in the first direction. Similarly, the drum cartridges 3Y, 3M, 3C include the photosensitive drums 6Y, 6M, 6C, respectively.

As illustrated in FIG. 3, the drum cartridge 3K has a wall 45 having an opening 42. The wall 45 includes a pressure member (not shown) so as to urge the developing cartridge 2K toward the photosensitive drum 6K. The IC chip 41 is exposed to the outside through the opening 42, when the developing cartridge 2K is attached to the drum cartridge 3K.

The surface of the photosensitive drum 6K and the surface of the developing roller 5 of the developing cartridge 2K are in contact with each other in the state where the developing cartridge 2K is attached to the drum cartridge 3K. Next, operation of the developing cartridge 2K moving away from the drum cartridge 3K will be described. The developing cartridge 2K makes a transition from a contacting state where the surface of the developing roller 5 of the developing cartridge 2K and the surface of the photosensitive drum 6K are in contact with each other to a separation state where the surface of the developing roller 5 is separated from the surface of the photosensitive drum 6K as a result of movement of the developing cartridge 2K relative to the drum cartridge 3K.

3.1 Lever

The drum cartridge 3K further includes a lever 21K for moving the developing cartridge 2K. Similarly, the drum cartridges 3Y, 3M, 3C include levers 21Y, 21M, 21C, respectively. These levers 21K, 21Y, 21M, 21C have structures identical to each other. Therefore, in the following description, the structure of the lever 21K will be described to avoid duplicating description with respect to the structure of the levers 21Y, 21M, 21C.

The lever 21K is positioned at a side surface of the drum cartridge 3*k* in the first direction. The lever 21K has one end portion 21A, another end portion 21B, and a shaft portion positioned between the one end portion 21A and the other end portion 21B and extending in the first direction. The lever 21K is pivotally movable about an axis of the shaft portion.

The drum cartridge 3K further includes another lever (not shown) positioned opposite to the lever 21K with respect to the casing 4 in the first direction. The other lever and the lever 21K are aligned with each other in the first direction. The other lever has a structure identical to that of the lever 21K.

The lever 21K is pivotally moved about the axis of the shaft portion when the other end portion 21B is pressed by a pivot member 32K described later. Therefore, the one end portion 21A is moved to contact and urge the protrusion 11. Thus, the developing cartridge 2K is moved relative to the drum cartridge 3K, so that the surface of the developing roller 5 and the surface of the photosensitive drum 6K are separated from each other. The pivot member 32K will next be described.

4. Pivot Member and Translation Cam

As illustrated in FIG. 2, the image forming apparatus 1 further includes a translation cam 31 and a plurality of pivot members 32K, 32Y, 32M, 32C.

4.1 Translation Cam 31

The translation cam 31 extends in the arraying direction of an array of the developing cartridges 2K, 2Y, 2M, 2C in a state where these cartridges 2K, 2Y, 2M, 2C are installed in the housing 1A.

The translation cam 31 has a first surface S1, a second surface S2, a rack 34 and a plurality of grooves 33K, 33Y, 33M, 33C. The first surface S1 is positioned closer to the developing cartridges 2K, 2Y, 2M, 2C than the second surface S2 to the developing cartridges 2K, 2Y, 2M, 2C.

The plurality of grooves 33K, 33Y, 33M, 33C are arrayed in the arraying direction of the developing cartridges 2K, 2Y, 2M, 2C with a distance between neighboring grooves. These grooves 33K, 33Y, 33M, 33C are recessed from the first surface S1 toward the second surface S2, respectively. Further, the groove 33K has a width in the arraying direction greater than that of the remaining grooves 33Y, 33M, 33C.

The rack 34 is positioned at one end portion of the translation cam 31 in the arraying direction, and gear teeth of rack 34 are arrayed in the arraying direction. The rack 34 is adapted to receive a driving force from the housing 1A side. Thus, the translation cam 31 is movable in the arraying direction.

4.2 Pivot Members

As illustrated in FIG. 2, the pivot members 32K, 32Y, 32M, 32C are arrayed in the arraying direction. The pivot member 32K is positioned between the photosensitive drums 6K and 6Y in the arraying direction. The pivot member 32Y is positioned between the photosensitive drums 6Y and 6M in the arraying direction. The pivot member 32M is positioned between the photosensitive drums 6M and 6C in the arraying direction. The pivot member 32C is positioned opposite to the photosensitive drum 6M with respect to the photosensitive drum 6C in the arraying direction. The pivot members 32K, 32Y, 32M, 32C have structures identical to each other. In the following description, the structure of the pivot member 32K will be described while omitting the description as to the pivot members 32Y, 32M, 32C.

Figure 4:
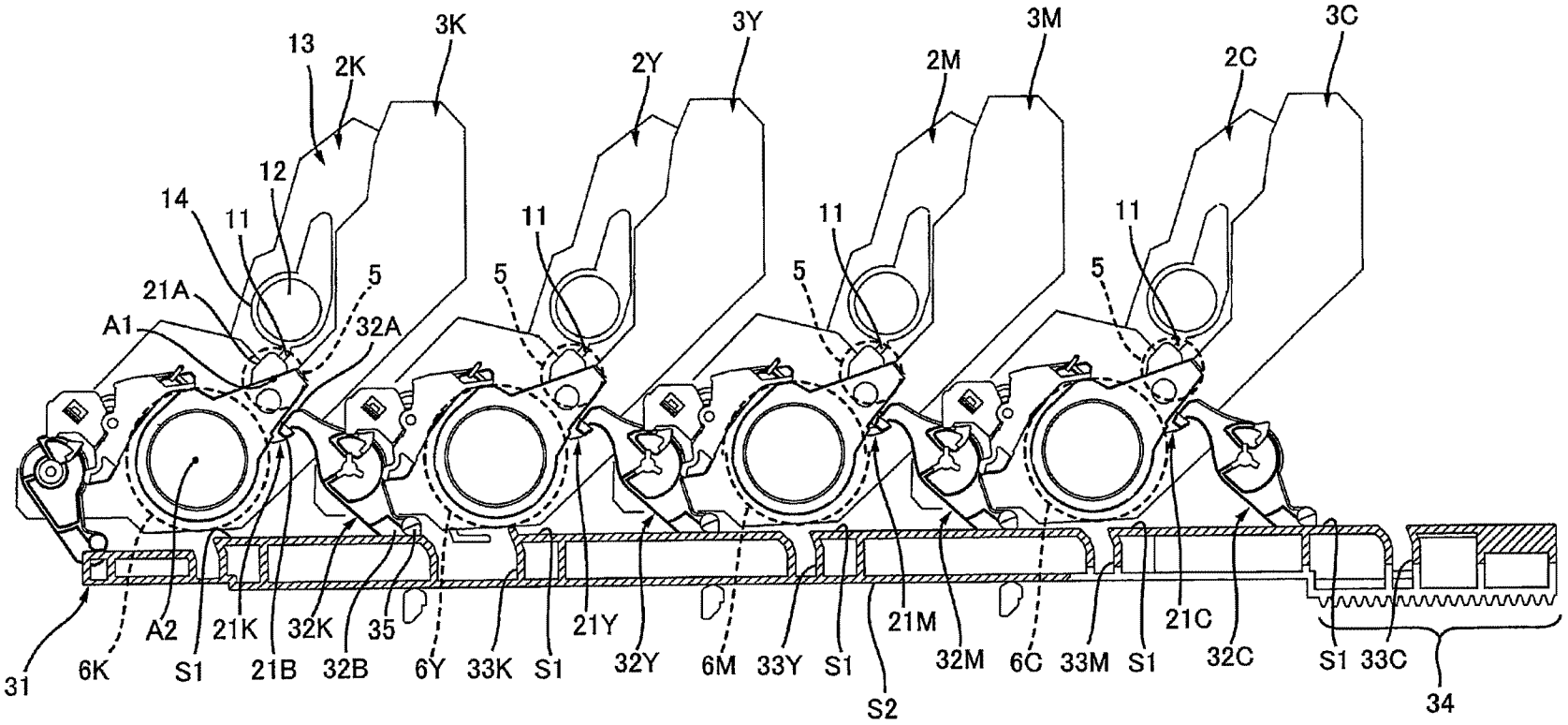
FIG. 4 is a view illustrating the developing cartridges at their second position in the image forming apparatus for forming a color image according to the first embodiment.

The pivot member 32K has one end portion 32A, another end portion 32B, and a shaft portion positioned between the one end portion 32A and the other end portion 32B. The pivot member 32K is pivotally movable about an axis of the shaft portion. The other end portion 32B includes a protrusion 35 extending in the first direction. As illustrated in FIG. 2, the protrusion 35 is engageable with the groove 33K of the translation cam 31. As illustrated in FIG. 4, in accordance with the movement of the translation cam 31 in the arraying direction, the protrusion 35 disengages from the groove 33K, so that the protrusion 35 moves about the axis of the shaft portion of the pivot member 32K. In this case, the other end portion 32B is pivotally moved about the axis of the shaft portion of the pivot member 32K, so that the one end portion 32A is also pivotally moved about the axis of the shaft portion of the pivot member 32K. Accordingly, the one end portion 32A abuts on and urges the other end portion 21B of the lever 21K (FIG. 4), so that the lever 21K is pivotally moved about the axis of the lever 21K. In accordance with the pivotal movement of the lever 21K, one end portion 21A of the lever 21K abuts on and urges the protrusion 11. Consequently, the developing cartridge 2K is moved relative to the drum cartridge 3K. In other words, the developing cartridge 2K is moved relative to the photosensitive drum 6K. Thus, the surface of the developing roller 5 and the surface of the photosensitive drum 6K are separated from each other.

Similarly, as illustrated in FIG. 2, the protrusion 35 of the pivot member 32Y is engaged with the groove 33Y, and then as illustrated in FIG. 4, the one end portion 32A of the pivot member 32Y contacts the other end portion 21B of the lever 21Y. Further, as illustrated in FIG. 2, the protrusion 35 of the pivot member 32M is engaged with the groove 33M, and then as illustrated in FIG. 4, the one end portion 32A of the pivot member 32M contacts the other end portion 21B of the lever 21M. Further, as illustrated in FIG. 2, the protrusion 35 of the pivot member 32C is engaged with the groove 33C, and then as illustrated in FIG. 4, the one end portion 32A of the pivot member 32C contacts the other end portion 21B of the lever 21C.

5. Communication Between IC Chip 41 and Components in the Image Forming Apparatus 1

As illustrated in FIGS. 1 and 2, the surfaces of the developing rollers 5 of the developing cartridges 2K, 2Y, 2M, 2C are in contact with the surfaces of the photosensitive drums 6K, 6Y, 6M, 6C, respectively, when the drum cartridges 3K, 3Y, 3M, 3C are mounted to the housing 1A while the developing cartridges 2K, 2Y, 2M, 2C are mounted to the drum cartridges 2K, 3Y, 3M, 3C, respectively. In this case, the position of the developing cartridges 2K, 2Y, 2M, 2C relative to the drum cartridges 3K, 3Y, 3M, 3C, respectively will be referred to as a first position.

When the cover 8 is at the closed position with the developing cartridges 2K, 2Y, 2M, 2C being at the first position, the electrical connectors 43K, 43Y, 43M, 43C are in confrontation with the IC chips 41 of the developing cartridges 2K, 2Y, 2M, 2C, respectively, with a space therebetween. That is, when the developing cartridges 2K, 2Y, 2M, 2C are at the first position, the electrical connectors 43K, 43Y, 43M, 43C are not in contact with the electrical contacts of the IC chips 41 of the developing cartridges 2K, 2Y, 2M, 2C, respectively.

Thereafter, the controller 44 controls driving of the motor (not shown) to execute a moving control for moving the developing cartridges 2K, 2Y, 2M, 2C.

The translation cam 31 is moved in the arraying direction upon receipt of the driving force from the motor (not shown) from a position illustrated in FIG. 2 to a position illustrated in FIG. 4.

Then, as illustrated in FIG. 4, the pivot member 32K is pivotally moved by the movement of the translation cam 31. The lever 21K is pivotally moved by being pressed by the pivot member 32K. The one end portion 21A of the lever 21K presses the protrusion 11 of the developing cartridge 2K, so that the developing cartridge 2K is moved relative to the drum cartridge 3K from the first position to a second position. As a result, the surface of the developing roller 5 is separated from the surface of the photosensitive drum 6K.

Similarly, each of the developing cartridges 2Y, 2M, 2C is moved relative to each of the drum cartridges 3Y, 3M, 3C, respectively, from the first position to the second position, so that each surface of each one of the developing rollers 5 is separated from each surface of each corresponding one of the photosensitive drums 6Y, 6M, 6C, respectively.

Figure 5:
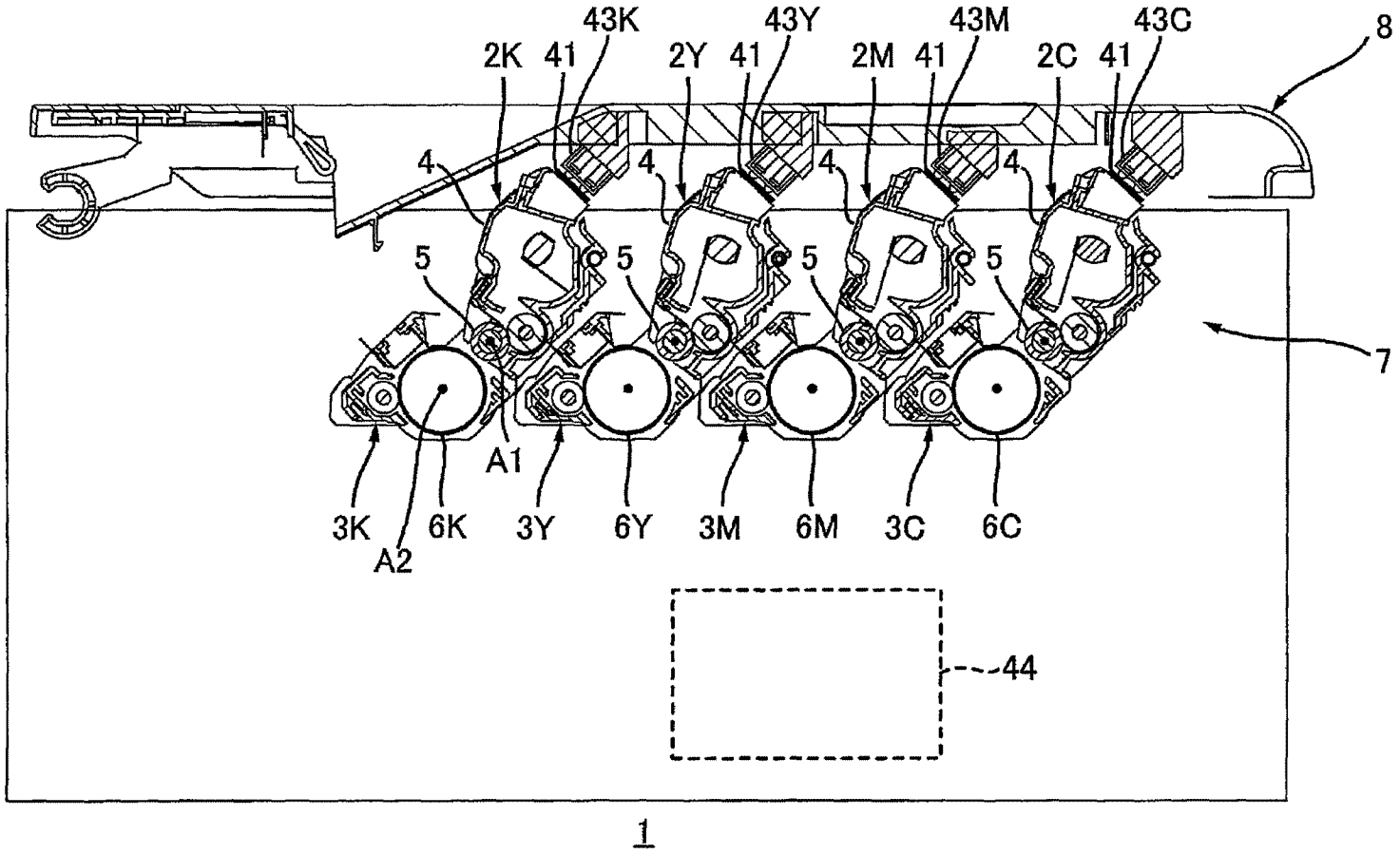
FIG. 5 is a view for description of a contacting state between an IC chip of the developing cartridge and an electrical connector in a state where the developing cartridges are at the second position.

As illustrated in FIG. 5, when the developing cartridge 2K is at the second position, the electrical connector 43K is in contact with the electrical contact of the IC chip 41 of the developing cartridge 2K. Similarly, when the developing cartridges 2Y, 2M, 2C are at the second position, the electrical connectors 43Y, 43M, 43C are in contact with the electrical contacts of the IC chips 41 of the developing cartridges 2Y, 2M, 2C, respectively.

Then, the controller 44 executes a communication control. In the communication control, the controller 44 allows the electrical connector 43K to start communication with the IC chip 41 of the developing cartridge 2K. Similarly, the controller 44 allows the electrical connectors 43Y, 43M, 43C to start communication with the IC chips 41 of the developing cartridges 2Y, 2M, 2C, respectively.

In this case, the controller 44 reads information related to the developing cartridge 2K from the IC chip 41 of the developing cartridge 2K. Further, the controller 44 writes information as to the developing cartridge 2K into the IC chip 41 of the developing cartridge 2K. Similarly, the controller 44 reads information related to the developing cartridges 2Y, 2M, 2C from the IC chips 41 of the developing cartridges 2Y, 2M, 2C, respectively. Further, the controller 44 writes information related to the developing cartridges 2Y, 2M, 2C into the IC chips 41 of the developing cartridges 2Y, 2M, 2C, respectively.

After the communication control, the controller 44 controls image forming operation in accordance with inputted print job.

In case of color printing, the controller 44 drives the motor (not shown) to move the translation cam 31 from the position illustrated in FIG. 4 to the position illustrated in FIG. 2. As a result, as illustrated in FIG. 2, the developing cartridges 2K, 2Y, 2M, 2C are moved to the first position. Then, the controller 44 controls the components of the image forming apparatus 1 to form a color image using at least one of the toners of the developing cartridges 2K, 2Y, 2M, 2C.

Figure 6:
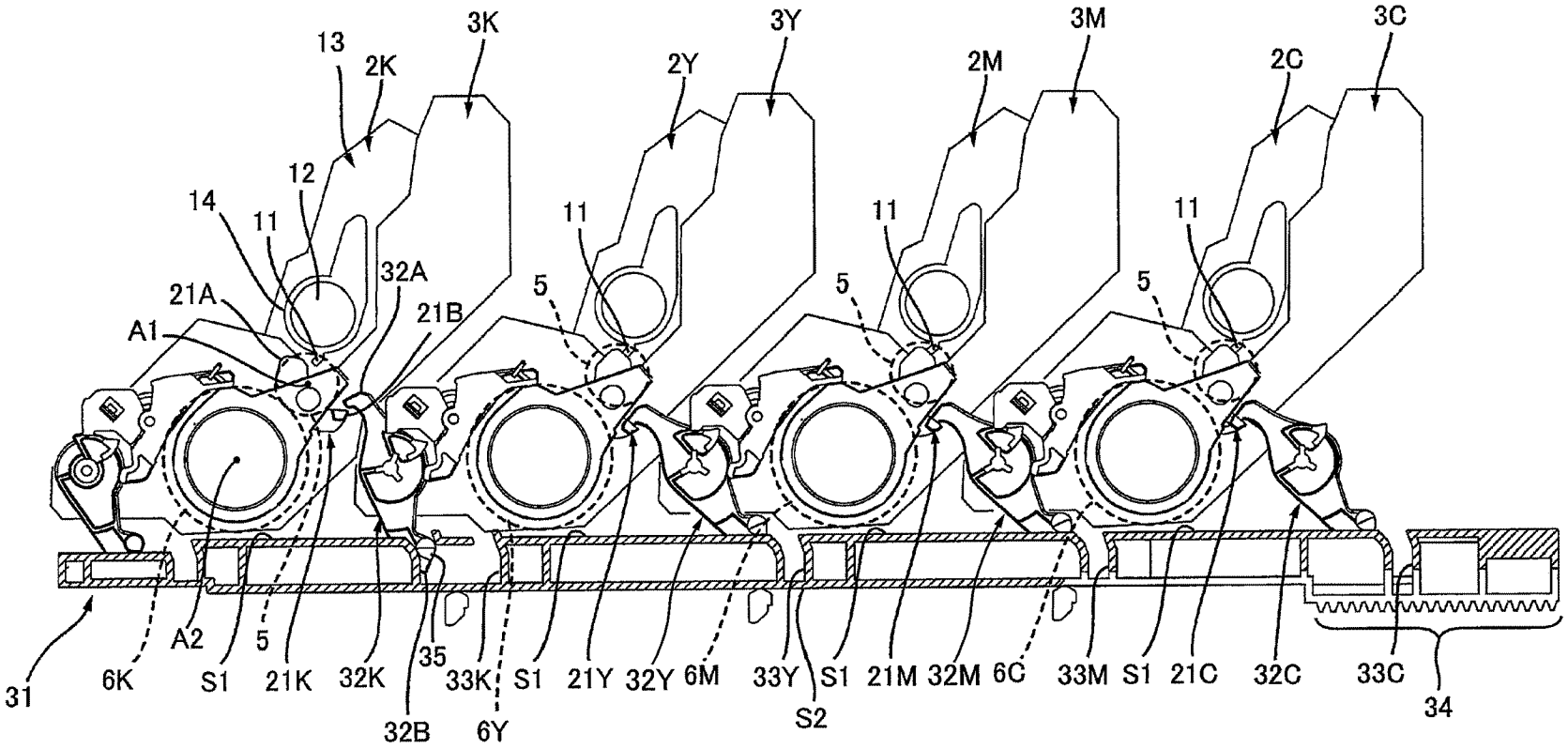
FIG. 6 is a view illustrating a black developing cartridge at its first position and yellow, magenta, cyan developing cartridges at their second position in the image forming apparatus for forming a monochromatic image according to the first embodiment.

In case of monochromatic printing, the controller 44 drives the motor (not shown) to move the translation cam 31 from the position illustrated in FIG. 4 to a position illustrated in FIG. 6. As a result, as illustrated in FIG. 6, the developing cartridge 2K is moved to the first position, whereas the developing cartridges 2Y, 2M, 2C are positioned at the second position. Incidentally, in this case, the controller 44 can perform communication with the IC chips 41 of the developing cartridges 2Y, 2M, 2C. Then, the controller 44 controls the components of the image forming apparatus 1 to form a monochromatic image using the toner of the developing cartridge 2K.

Incidentally, after image forming operation by the components of the image forming apparatus 1 is completed, the controller 44 can perform communication with the IC chips 41 of the developing cartridges 2K, 2Y, 2M, 2C by again moving the translation cam 31 to the position illustrated in FIG. 4.

6. Function and Effect

The electrical contacts of the IC chips 41 are not in contact with the electrical connectors of the housing 1A when the developing rollers 5 are in pressure contact with the photosensitive drums for performing image forming operation. On the other hand, the electrical contacts of the IC chips 41 are in contact with the electrical connectors of the housing 1A when the developing rollers 5 of the developing cartridges which are not required for image forming operation are separated from the photosensitive drums. Accordingly, contacting pressure of the electrical connectors against the IC chips 41 does not act on the contact between the developing rollers 5 and the photosensitive drums, thereby stabilizing imaging quality.

Second Embodiment

Figure 7:
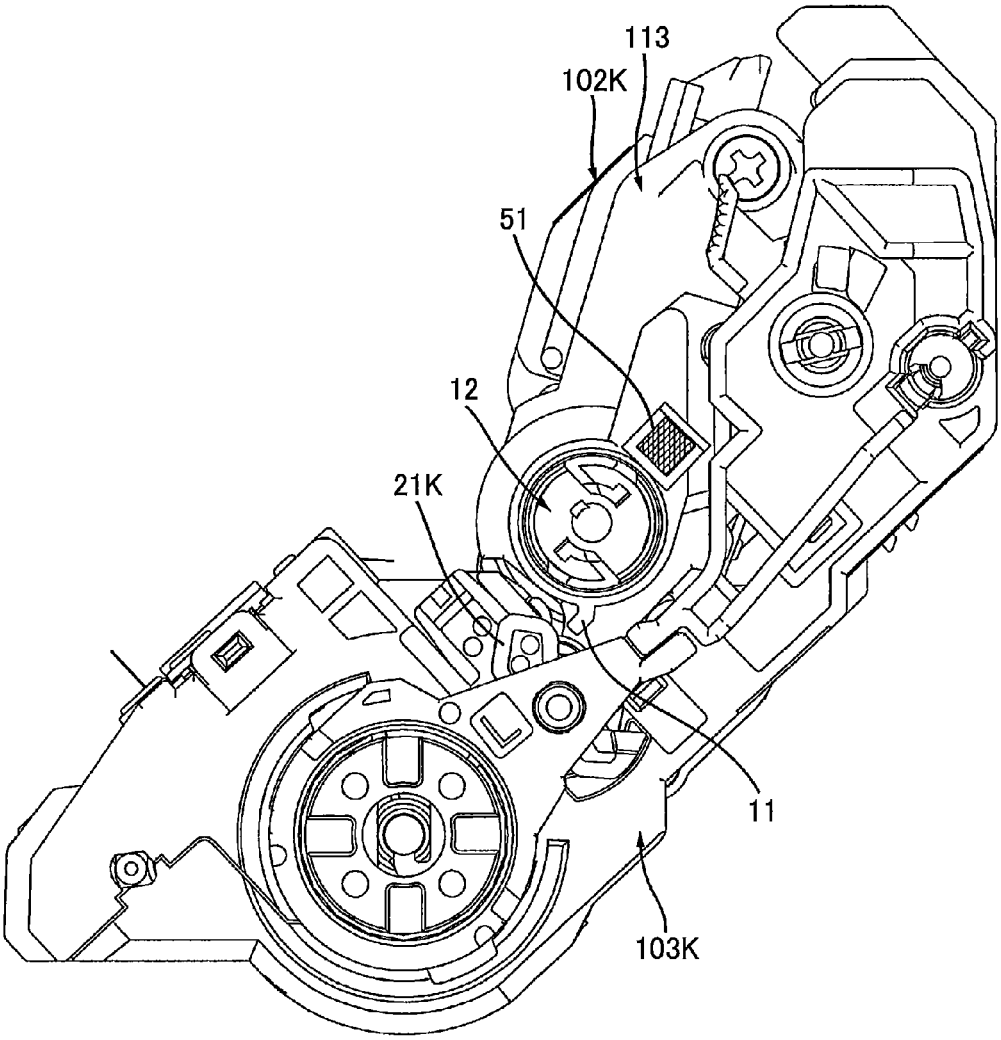
FIG. 7 is a side view of a developing cartridge and a drum cartridge in an image forming apparatus according to a second embodiment.

An image forming apparatus according to a second embodiment will be described with reference to FIGS. 7 through 8B, wherein like parts and components are designated by the same reference numerals as those shown in the first embodiment to avoid duplicating description.

A structure of a developing cartridge 102K will be described. As illustrated in FIG. 7, an IC chip 51 is positioned at a side surface of a gear cover 113 in the first direction. More specifically, the IC chip 51 is positioned at and adhered to an outer side surface of the gear cover 113.

The IC chip 51 is exposed to the outside through a side wall of a drum cartridge 103K in the first direction, when the developing cartridge 102K is attached to the drum cartridge 103K.

Figure 8A:
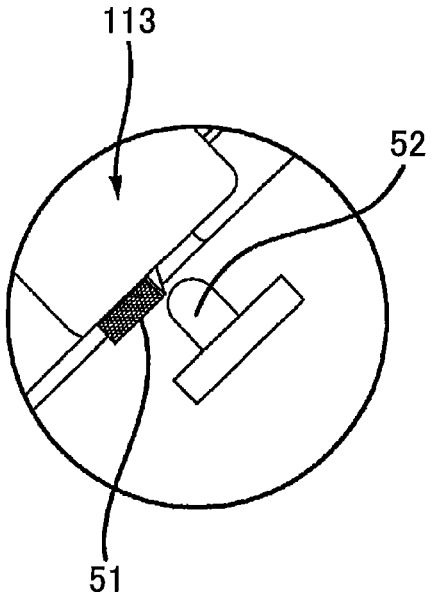
FIG. 8A is a view illustrating a state where an IC chip and an electrical connector have not been contacted with each other while the developing cartridge is at a first position in the image forming apparatus according to the second embodiment.

As illustrated in FIG. 8A, the IC chip 51 is separated from an electrical connector 52 when the developing cartridge 102K is positioned at the first position relative to the drum cartridge 103K. In this case, an electrical contact of the IC chip 51 is out of contact with the electric connector 52.

Figure 8B:
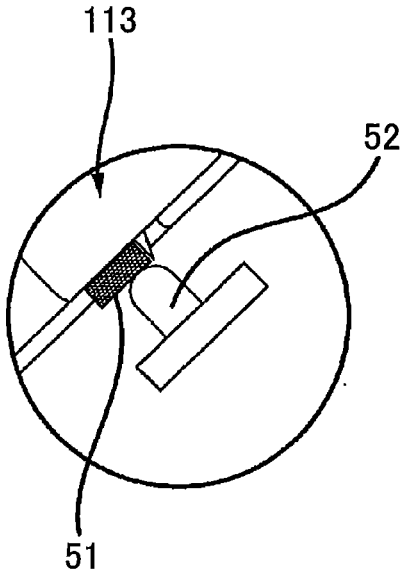
FIG. 8B is a view illustrating a state where the IC chip and the electrical connector are in contact with each other while the developing cartridge is at a second position in the image forming apparatus according to the second embodiment.

As illustrated in FIG. 8B, the IC chip 51 is in confrontation with the electrical connector 52 in the first direction, and further, the electrical contact of the IC chip 51 is in contact with the electrical connector 52, when the developing cartridge 102K is positioned at the second position relative to the drum cartridge 103K. The electrical connector 52 is, for example, fixed to an inner surface of the accommodating portion 7. Function and effect in the second embodiment are the same as those of the first embodiment.

Third Embodiment

An image forming apparatus according to a third embodiment will be described with reference to FIGS. 9 through 12B, wherein like parts and components are designated by the same reference numerals as those shown in the first embodiment to avoid duplicating description.

Figure 9:
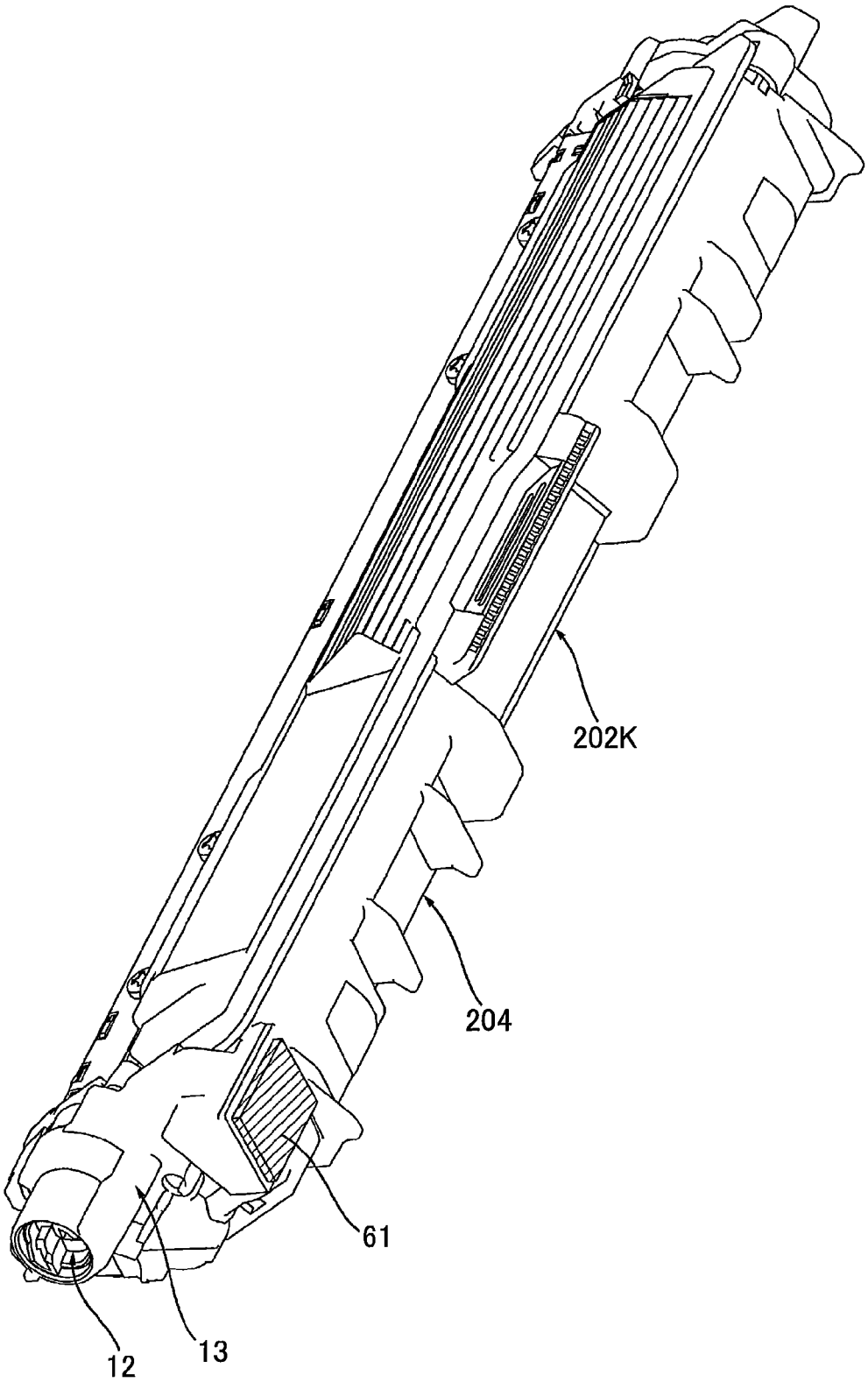
FIG. 9 is a perspective view of a developing cartridge according to a third embodiment.

As illustrated in FIG. 9, the developing roller 5 and an IC chip 61 are positioned at one end portion and another end portion of a casing 204, respectively, in the second direction. More specifically, the IC chip 61 is positioned at and adhered to an outer surface of the other end portion of the casing 204 in the second direction. Further, the IC chip 61 is positioned at an end portion of a developing cartridge 202K in the first direction.

Figure 10:
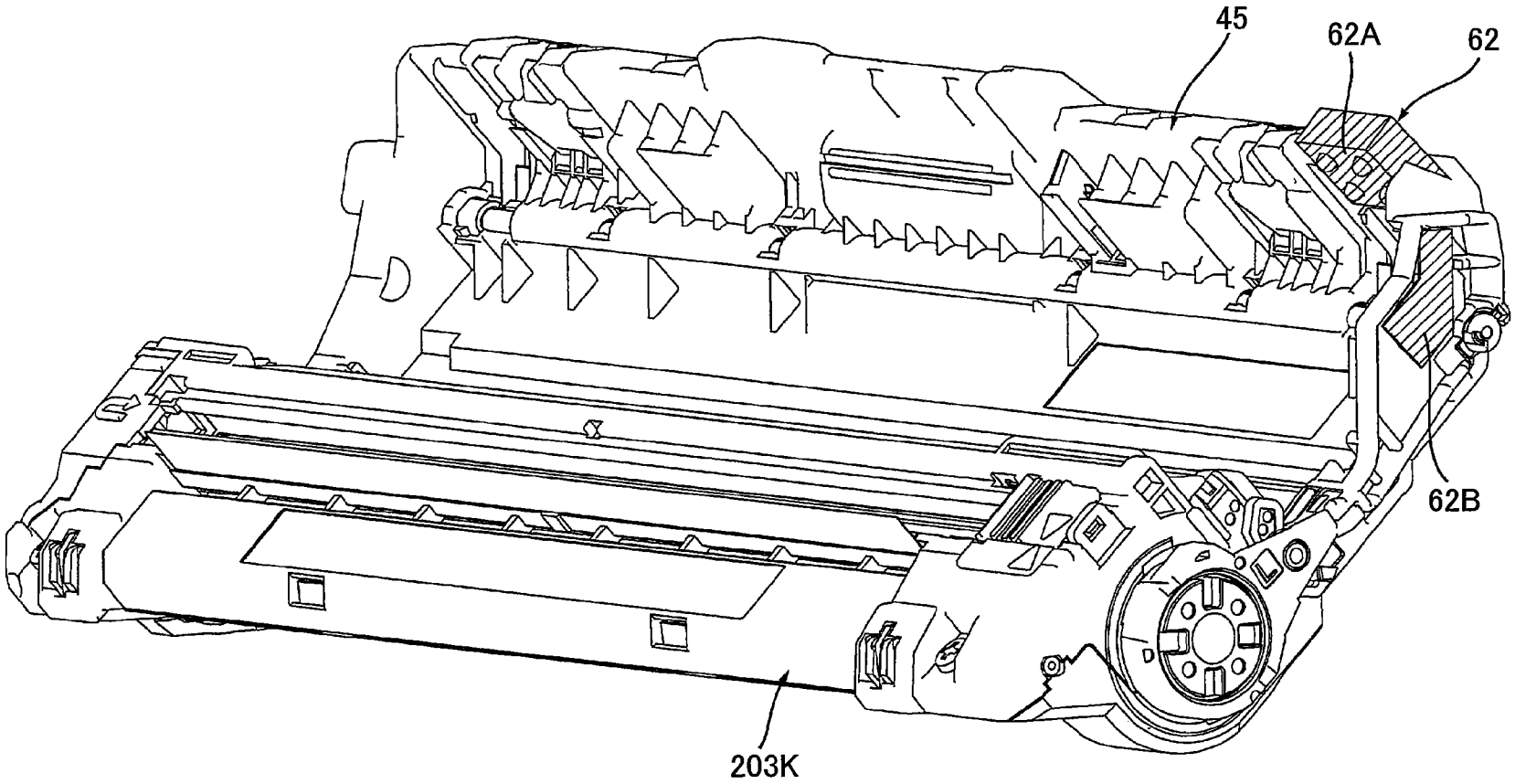
FIG. 10 is a perspective view of a drum cartridge according to the third embodiment.

As illustrated in FIG. 10, a drum cartridge 203K includes a relay electrode 62 electrically contactable with an electrical contact (an example of a first electrical contact) of the IC chip 61 of the developing cartridge 202K. Each of electrical connectors 63 provided in an accommodating portion 207 as illustrated in FIG. 11 is in contact with each of the relay electrodes 62 so as to communicate with each of the IC chips 61 through the relay electrodes 62.

As illustrated in FIG. 10, the relay electrode 62 is positioned at one end portion of the drum cartridge 203K in the first direction. The relay electrode 62 includes an electrical contact 62A (an example of a second electrical contact) and another electrical contact 62B (an example of a third electrical contact). The electrical contact 62A is in confrontation with the IC chip 61 when the developing cartridge 202K is attached to the drum cartridge 203K. The other electrical contact 62B is positioned at a side surface of the drum cartridge 203K in the first direction. The other electrical contact 62B is electrically connected to the electrical contact 62A.

Figure 11:
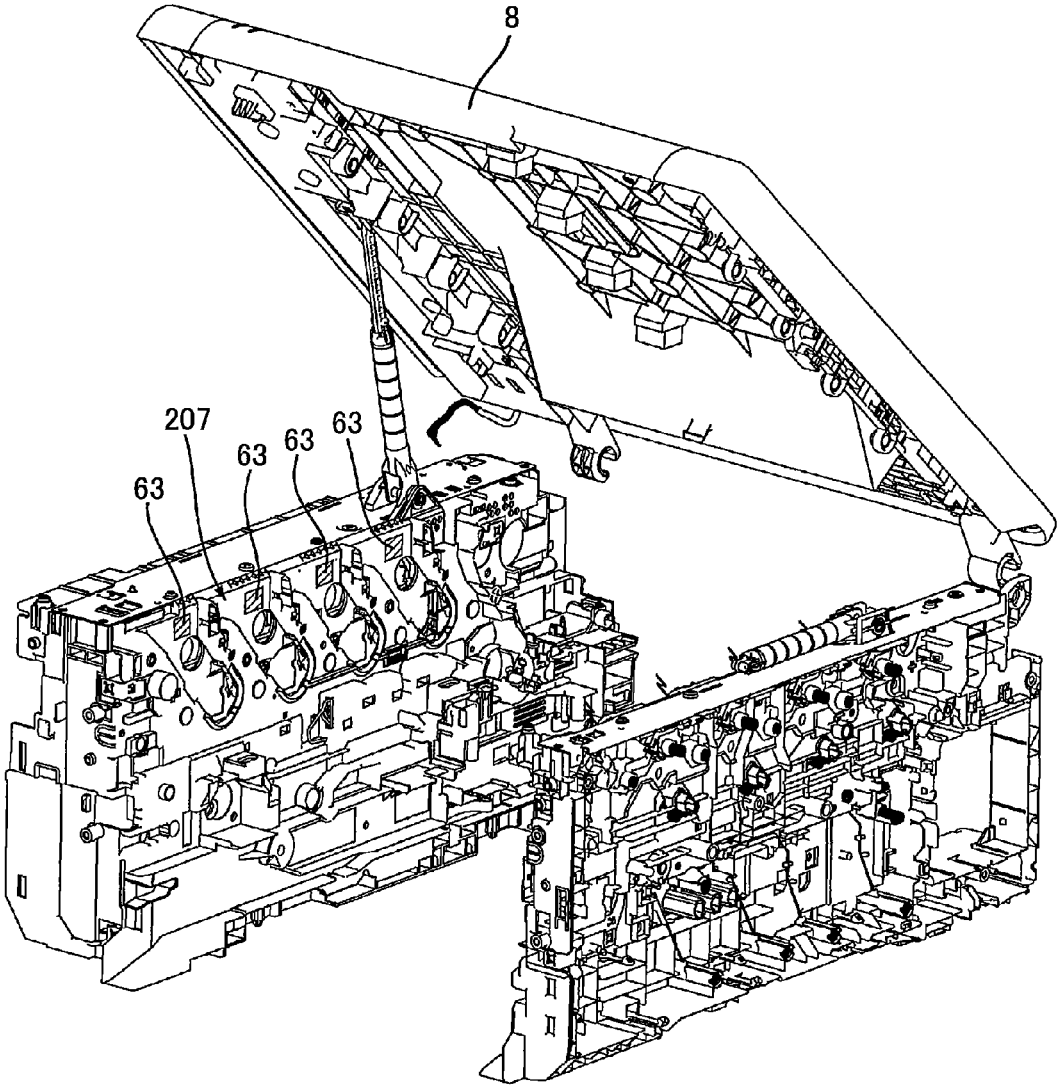
FIG. 11 is a perspective view of an image forming apparatus according to the third embodiment, and particularly illustrating electrical connectors.

As illustrated in FIG. 11, the electrical connectors 63 are positioned at an inner surface of the accommodating portion 207 in the first direction. More specifically, the electrical connector 63 is brought into contact with the other electrical contact 62B of the drum cartridge 203K when the drum cartridge 203K is attached to the accommodating portion 207 while the developing cartridge 202K is attached to the drum cartridge 203K.

Figure 12A:
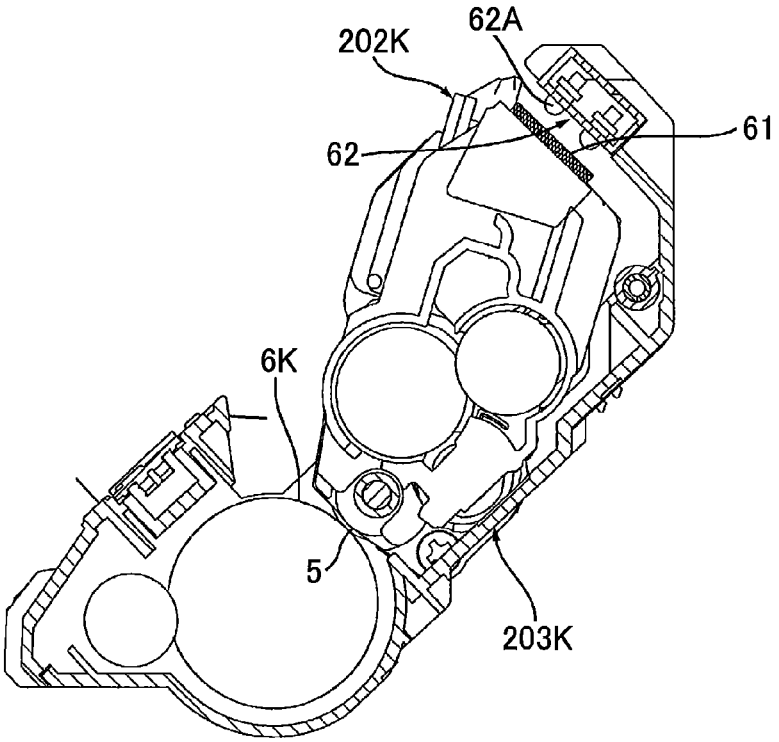
FIG. 12A is a view illustrating a state where the developing cartridge is at a first position, and an IC chip and a relay electrode are positioned apart from each other in the image forming apparatus according to the third embodiment.

As illustrated in FIG. 12A, the IC chip 61 of the developing cartridge 202K is spaced away from the electrical contact 62A of the drum cartridge 203K when the developing cartridge 202K is at the first position relative to the drum cartridge 203K. In this case, the electrical contact of the IC chip 61 is separated from the electrical contact 62A.

Figure 12B:
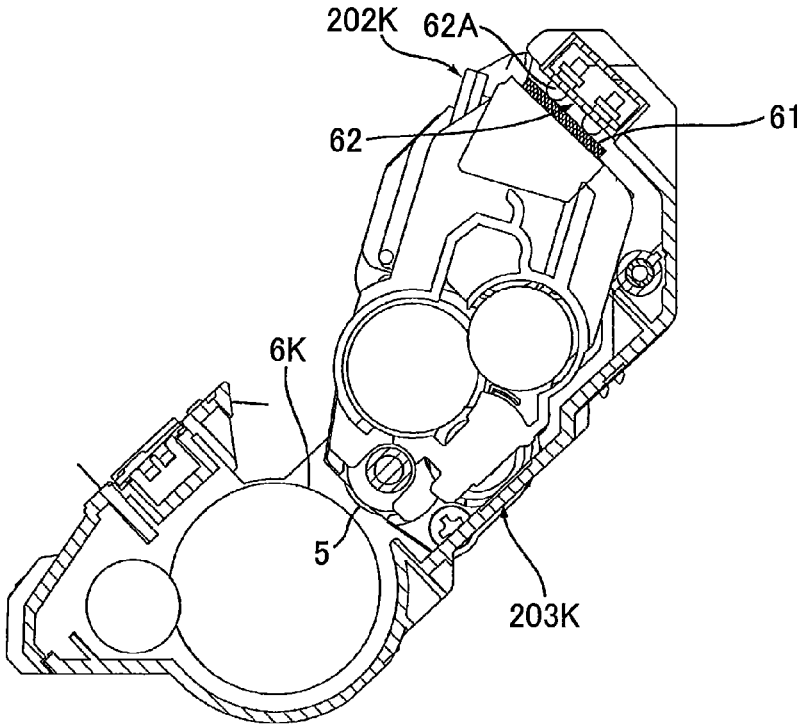
FIG. 12B is a view illustrating a state where the developing cartridge is at a second position, and the IC chip and the relay electrode are in contact with each other in the image forming apparatus according to the third embodiment.

As illustrated in FIG. 12B, the IC chip 61 is in contact with the electrical contact 62A when the developing cartridge 202K is positioned at the second position relative to the drum cartridge 203K. Thus, the electrical connector 63 is electrically connected to the IC chip 61 through the relay electrode 62. The third embodiment provides the function and effect similar to those of the first embodiment.

[Modifications]

Instead of the above-described plurality of drum cartridges, a single drum unit including a plurality of photosensitive drums can be used. The drum unit can be pulled out of and pulled in the housing 1A.

Further, in the above-described embodiments, the drum cartridge including the photosensitive drum is attached to and detached from the housing 1A. However, a plurality of photosensitive drums can be provided to the housing 1A.

Further, in the above-described embodiments, the image forming apparatus 1 includes the photosensitive drums 6K, 6Y, 6M, 6C for color printing. However, an image forming apparatus can be a monochromatic printer in which the photosensitive drums 6Y, 6M, 6C are not provided.

Further, in the above-described embodiments, the IC chip includes the memory and the electrical contact integral therewith. However, an electrical contact and an IC chip including a memory may be provided separately, and the electrical contact and the IC chip may be electrically connected to each other.

While the description has been made in detail with reference to specific embodiments, it would be apparent to those skilled in the art that various changes and modifications may be made thereto.

What is claimed is:

1. An image forming apparatus comprising:

a developing cartridge comprising:

a developing roller rotatable about a first axis extending in a first direction;

a memory configured to store information related to the developing cartridge; and an electrical contact electrically connected to the memory;

a drum cartridge comprising:

a photosensitive drum rotatable about a second axis extending in the first direction; and a lever configured to move the developing cartridge between a first position at which a surface of the developing roller and a surface of the photosensitive drum are in contact with each other and a second position at which the surface of the developing roller and the surface of the photosensitive drum are out of contact with each other; and an electrical connector configured to be in contact with the electrical contact in a state where the developing cartridge is positioned at the second position, the electrical connector being configured to be out of contact with the electrical contact in a state where the developing cartridge is positioned at the first position.

2. The image forming apparatus according to claim 1, further comprising:

a housing;

wherein the drum cartridge is configured to be attached to the housing, the developing cartridge being configured to be attached to the drum cartridge, the drum cartridge including the photosensitive drum.

3. The image forming apparatus according to claim 1, further comprising:

another developing cartridge comprising:

another developing roller rotatable about a third axis extending in the first direction;

another memory configured to store information related to the another developing cartridge; and another electrical contact electrically connected to the another memory; and another photosensitive drum rotatable about a fourth axis extending in the first direction, the another developing cartridge being movable between a third position at which a surface of the another developing roller and a surface of the another photosensitive drum are in contact with each other and a fourth position at which the surface of the another developing roller and the surface of the another photosensitive drum are out of contact with each other, wherein the developing cartridge is movable between the first position and the second position relative to the photosensitive drum, the another developing cartridge being movable between the third position and the fourth position relative to the another photosensitive drum.

4. The image forming apparatus according to claim 3, further comprising:

a housing; and another drum cartridge including the another photosensitive drum, the drum cartridge and the another drum cartridge being configured to be attached to the housing, wherein the developing cartridge is configured to be attached to the drum cartridge, the another developing cartridge being configured to be attached to the another drum cartridge.

5. The image forming apparatus according to claim 1, wherein the developing cartridge has one end portion and another end portion in a second direction different from the first direction, the another end portion having an outer surface, the developing roller being positioned at the one end portion, and the electrical contact being positioned at the outer surface.

6. The image forming apparatus according to claim 5, wherein the memory is positioned at the outer surface.

7. The image forming apparatus according to claim 5, further comprising:

a housing including an accommodating portion configured to accommodate the developing cartridge; and a cover configured to cover the accommodating portion and movable between an open position allowing the developing cartridge to be detached from the accommodating portion and a closed position covering the developing cartridge accommodated in the accommodating portion, the electrical connector being provided at the cover.

8. The image forming apparatus according to claim 1, wherein the developing cartridge has an outer end surface in the first direction, the electrical contact being positioned at the outer end surface.

9. The image forming apparatus according to claim 1, further comprising a controller configured to control the image forming apparatus, the controller being configured to execute:

a moving control to instruct the lever to move the developing cartridge from the first position to the second position; and a communication control to instruct the electrical connector to start communication with the memory after the moving control.

* * * * *